United States Patent [19]
Dechelette
[11] 4,317,608
[45] Mar. 2, 1982

[54] SLOTTED PATE TERMINAL FOR STRANDED WIRE

[75] Inventor: Helen Dechelette, St. Cloud, France
[73] Assignee: AMP Incorporated, Harrisburg, Pa.

[21] Appl. No.: 159,014
[22] Filed: Jun. 13, 1980

[30] Foreign Application Priority Data

Jun. 29, 1979 [FR] France ..... 79 17039
Jan. 8, 1980 [FR] France ..... 80 00301

[51] Int. Cl.[3] ..... H01R 13/38
[52] U.S. Cl. ..... 339/99 R
[58] Field of Search ..... 339/97 R, 97 P, 98, 339/99 R

[56] References Cited

U.S. PATENT DOCUMENTS 3,718,888 2/1973 Pasternak ..... 339/98
3,936,128 2/1976 D'Annessa et al. ..... 339/98
4,085,994 4/1978 Volinskie ..... 339/95 R
4,116,522 9/1978 Reynolds ..... 339/97 R
4,118,103 10/1978 Leidy et al. ..... 339/98
4,159,158 6/1979 Weidler ..... 339/97 P
4,212,509 7/1980 Brooks et al. ..... 339/97 R
4,283,105 8/1981 Ferrill et al. ..... 339/97 R

*Primary Examiner*—Joseph H. McGlynn
*Attorney, Agent, or Firm*—AMP Incorporated

[57] ABSTRACT

An electrical contact member comprises a conductive plate (4) having therein a slot (5) open to an edge of the plate (4), the slot (5) having a mouth (28) at the edge of the plate (4) and leading to a first inwardly tapering section (29) which leads to a second parallel straight sided section (30), the second section (30) leading into a third inwardly tapering section (31) having convex converging sides leading to a throat (32) which opens into a fourth outwardly tapering section (33) leading into a fifth inwardly tapering section (34) having convex converging sides, the maximum width of the fifth section (34) being less than that of the third section (31), the fifth section (34) defining a closed end (35) for the slot (5). When used with a conductor (100) having a stranded core the slot shape of the contact serves to retain the strands in as near as possible their original relative positions, thus ensuring reliable connection.

14 Claims, 13 Drawing Figures

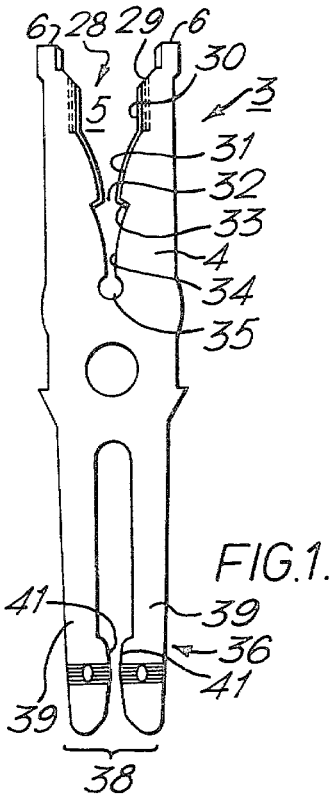
FIG.1.
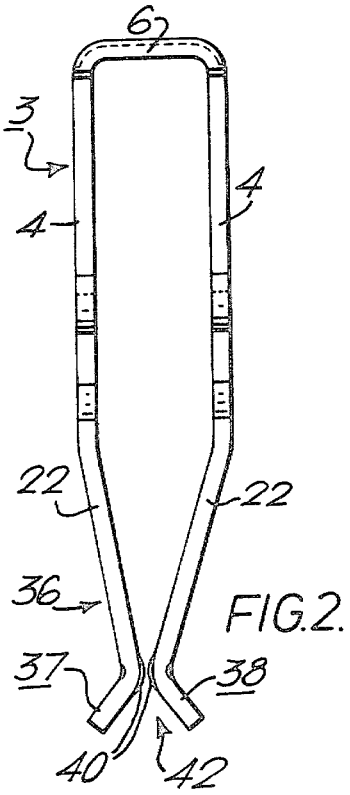
FIG.2.
FIG.3.
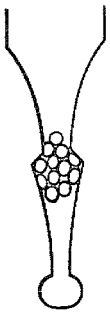
FIG.4.
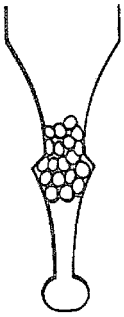
FIG.5.
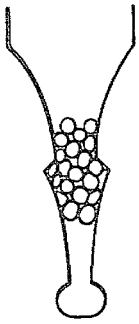
FIG.6.
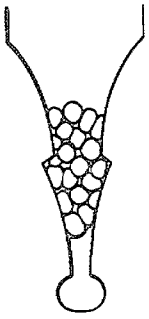

9
10
21
17
13
12
10
9
8
16
11
19
18
19
18
13
6
12
5
5
18
V
4
4
3
II
6

14
7
15
II
22
7
15
2
14
20
20
23
2
1
20
IV

SLOTTED PATE TERMINAL FOR STRANDED WIRE

This invention relates to an electrical contact member, and particularly to an electrical contact member comprising a conductive plate having therein a slot open to an edge of the plate, into which slot an insulated electrical conductor can be urged transversely of the axis of the conductor such that the walls of the slot penetrate the insulation of the conductor and establish electrical connection to the conductive core of the conductor, and to an electrical connector comprising a housing of electrically insulating material carrying a plurality of such contact members.

Many such electrical contact members are known, in which the slot has a mouth at the edge of the plate and leading to a first inwardly tapering section which leads to a second parallel straight sided section.

With such known contact members the first section of the slot serves primarily to cut through the insulation of an inserted conductor, while the second section serves to receive and establish electrical connection to the conductive core of the conductor.

Such known contact members are generally satisfactory for use with conductors having a single solid conductive core, but are often unsatisfactory for use with conductors having a conductive core composed of a plurality of conductive strands.

The difficulties encountered with stranded core conductors are believed to derive from the rearrangement of the strands relative to each other which occurs as the conductor is urged into the slot in the contact member. In the conductor the strands are generally arranged to give as near as possible a circular cross-section for the core, but on insertion into the slot the strands are generally forced into a linear arrangement.

Such rearrangement of the strands into a linear arrangement does not occur when a contact member is connected to a stranded core conductor using conventional crimping techniques with a ferrule being compressed about the core, and it is known that conventional crimping techniques provide good and reliable electrical and mechanical connections.

According to this invention in a known electrical contact member as discussed above the second section leads into a third inwardly tapering section having convex converging sides leading to a throat which opens into a fourth outwardly tapering section leading into a fifth inwardly tapering section having convex converging sides the maximum width of the fifth section being less than that of the third section, the fifth section defining a closed end for the slot.

Preferably the first section has converging straight lines.

With the contact member of this invention the first section of the slot serves to guide an insulated conductor into the second section which serves to cut through the insulation, possibly right up to the core of the conductor. The conductor then enters the third section of the slot which serves to complete cutting of the insulation up to the core of the conductor, if this is necessary, while serving in the case of a multi-strand core in the conductor, to maintain the strands as near as possible in their original arrangement in the conductor, this being achieved by the convex tapering sides of the third section providing a progressively steadily increasing force against the conductor. The conductor then passes at least partially through the throat into the fourth section of the slot, with a substantial proportion of the strands of the core being received in the fifth section of the slot. The walls of the fourth section of the slot constitute shoulders facing the closed end of the slot, and this serves to retain the strands in the slot in an arrangement as near to their original arrangement in the conductor as possible, with the strands being compressed between the slot walls.

Thus, the contact member of this invention provides a good, reliable electrical and mechanical connection to a conductor having a multi-strand core, and also has the further advantage that such connection can be made to conductors within a relatively wide size range, for example to conductors having a core cross-sectional area between 0.6 $mm^2$ and 2.0 $mm^2$.

An electrical contact member, and an electrical connector comprising a housing of electrically insulating material carrying a plurality of such contact members, according to this invention will now be described by way of example with reference to the drawings, in which:

FIG. 1 is a side elevational view of the contact member;

FIG. 2 is a side elevational view of the contact member at right-angles to the view of FIG. 1;

Figure 7:
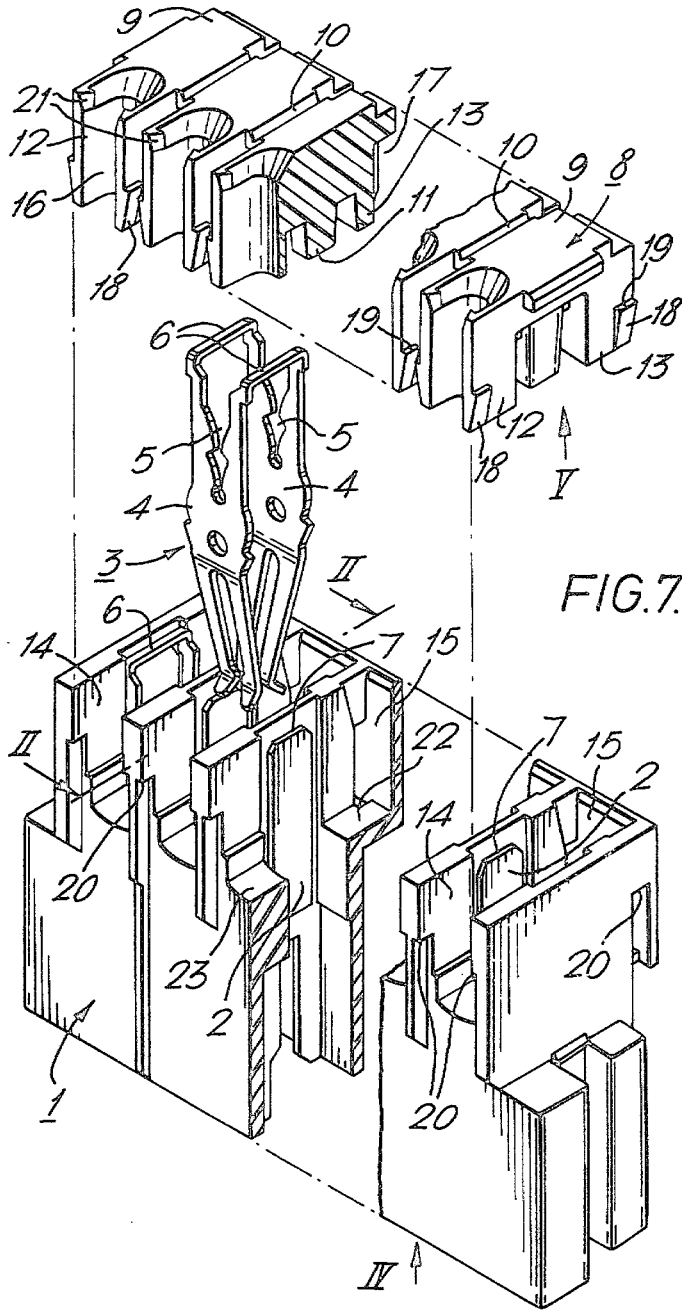
Figure 8:
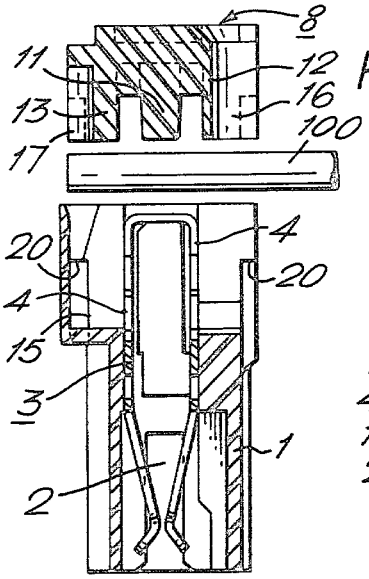
Figure 9:
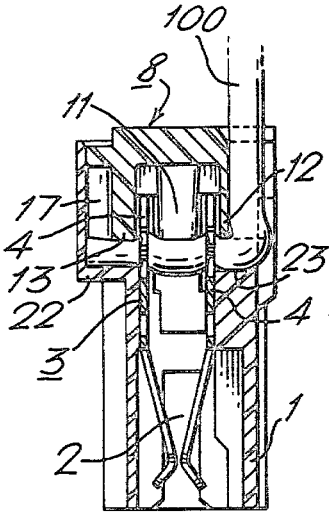
Figure 10:
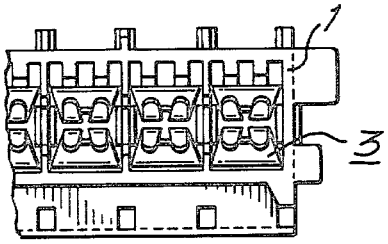
Figure 11:
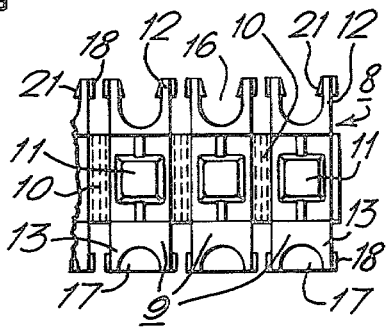
Figure 13:
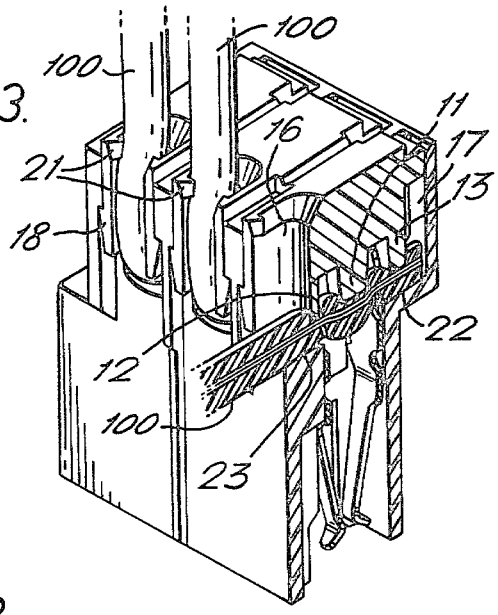
Figure 12:
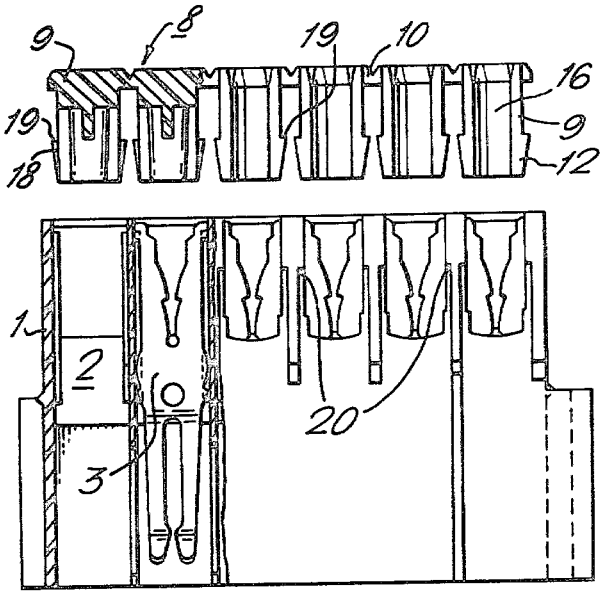

FIGS. 3 to 6 diagrammatically illustrate use of the contact member with four different sizes of conductor;

FIG. 7 is an exploded perspective view of the connector with parts broken away;

FIG. 8 is a section on the line II—II in FIG. 7 and showing a conductor to be connected to the connector;

FIG. 9 is a view similar to FIG. 2 but showing the conductor connected to the connector;

FIG. 10 is a view in the direction of the arrow IV in FIG. 7 of the connector in the assembled state;

FIG. 11 is a view in the direction of the arrow V in FIG. 1, of the cover member of the connector;

FIG. 12 is a partly sectional side elevational view of the connector in a partly assembled state; and FIG. 13 is a sectional perspective view of the connector with conductors connected thereto.

The contact shown in FIGS. 1 and 2 is stamped and formed from sheet metal, and comprises a conductor connection portion 3 and a contact portion 36.

The portion 3 comprises two similar plates 4 arranged in spaced parallel planes, the plates being joined by two bridging strips 6 extending between the plates 4 from adjacent edges thereof.

Each plate 4 has a slot 5 therein, and since the slots 5 are similar only one thereof will be described in detail with particular reference to FIG. 1.

Each slot 5 has a mouth 28 at the edge of the plate from which the bridging strips 6 extend, the bridging strips 6 being on opposite sides of the mouth 28.

The mouth 28 leads to a first inwardly tapering section 29 having converging straight sides, which in turn leads to a second parallel straight sided section 30. Preferably the sides of the second section 30 are bevelled to provide relatively sharp cutting edges.

The second section 30 leads into a third inwardly tapering section 31 having convex converging sides leading to a throat 32.

The throat 32 opens into a short fourth outwardly tapering section 33 the walls of which constitute shoulders facing away from the throat 32.

The fourth section 33 leads into a fifth inwardly tapering section 34 having convex converging sides, the maximum width of the fifth section 34 being less than that of the third section 31.

The fifth section 34 terminates in an enlarged circular aperture 35 which serves in known manner to determine the resiliency of two arms of the portion 3 defining the slot 5.

For use of the contact member described above an insulated conductor having a core formed from a plurality of strands is urged transversely of its axis into the slot 5 through the mouth 28. The first section 29 guides the conductor into the second section 30, the sharp edges of which cut through the insulation of the conductor, possibly up to the core thereof depending upon the size, that is the diameter, of the conductor.

The conductor then enters the third section 31 of the slot 5, the walls of which section 31 complete the cutting of the insulation of the conductor if necessary, and also apply a gradually increasing compressive force on to the core of the conductor while guiding the core to the throat 32.

The core then at least partially passes through the throat 32 into the fourth and fifth sections 33 and 34 of the slot 5, the walls of the fourth section 33 engaging over some of the strands of the core to retain the core in the slot 7.

FIGS. 3 to 6 diagrammatically illustrates a slot as described above having four different sizes of core therein, the core size increasing from FIG. 3 to FIG. 6. It can clearly be seen that in each case the core is engaged under the shoulders formed by the sides of the fourth section of the slot, with the strands of the core being compressed between the sides of the third and fifth sections of the slot, thereby to establish an electrical and mechanical connection between the core and the contact member containing the slot.

As described, the contact shown in FIGS. 1 and 2 contains two slots as described above, and for termination a conductor would be urged into the two slots simultaneously thereby to establish connection to the conductor at two spaced locations, in known manner.

As shown in FIG. 1, the two slots in the contact are of mutually different width over their second, third and fourth sections 30, 31 and 33, the slot in the rear (in FIG. 1) plate being narrower than that in the front plate over these sections. Such a contact is usable with a relatively wide range of conductor sizes since it is ensured that at the ends of the range at least one of the slots will give a satisfactory connection while over most of the range both slots will give a satisfactory connection.

Considering now the contact portion 36 of the contact shown in FIGS. 1 and 2, as shown this comprises two opposed pairs 37 and 38 of resilient contact arms 39, each arm 39 presenting a first rounded contact surface 40 to the opposed arm 39 of the other pair, and presenting a second rounded contact surface 41 to the other arm 39 of the same pair. The two pairs of opposed first contact surfaces 40 define a first slot into which a substrate such as a printed circuit board, or a male tab contact, can be inserted for connection to the contact, while the two pairs of opposed second contact surfaces 41 define a second such slot into which a similar substrate or male contact can be inserted, the first and second slots thus defined being mutually perpendicular.

As clearly shown in FIG. 2, the free ends of the arms 39 of each pair 37 or 38 are bent to provide a flared mouth 42 for the first slot defined by the first contact surfaces 40.

Such a contact portion 2 gives the advantage that a plurality of the contacts can be mounted in a common housing in the same orientation, this making connection of conductors to the conductor connection portions of the contacts easy, to provide a connector capable of being mated with an array of male tab contacts in which the tabs are arranged in mutually perpendicular planes, such as is found on automobile headlight bulbs.

Referring now to FIGS. 7 to 13, the connector here shown comprises a housing body 1 moulded from electrically insulating plastics material, and providing a row of elongate cavities 2 each open at both ends, each of which cavities 2 receives a contact member as shown in FIGS. 1 and 2.

The connector also includes a cover member 8 also moulded from electrically insulating plastics material, and comprising a row of segments 9 (best seen in FIGS. 11 and 12) interconnected by web portions 10. Each segment 9 is shaped to be received in an end of a cavity 2 in the housing body 1, the web portions 10 then overlying the walls between adjacent cavities 2.

Each segment 9 of the cover member 8 includes a central projection 11 shaped to be received between the plates 4 and strap portions 6 of a contact member when the cover member 8 is applied to the housing body 1, thereby to serve as a stuffer member for a conductor 100 to be connected to the contact member, as will be described below.

On either side of the stuffer member 11 there is a further stuffer projection 12 or 13 each shaped to be received in a corresponding recess 14 or 15 in the housing body 1, such that the two pairs of projections 11 and 12, and 11 and 13, embrace end portions of the two plates 4 of the contact member, respectively, as best seen in FIG. 9.

The projection 12 on each segment 9 of the cover member 8 is formed with a channel 16 which is open to the end face and to both the top and bottom faces of the segment 9, and the recess 14 in the body member 1 which receives this projection 12 is open to the side face of the housing body 1.

The projection 13 of each segment 9 of the cover member 8 is formed with a channel 17 which is open to the end face and the bottom face only of the segment 9, and the recess 15 in the body portion 1 which receives this projection 13 is closed at the side face of the housing body 1.

The side faces of the projections 12 and 13 of each segment 9 of the cover member 8 are formed with ramps 18 providing shoulders 19 facing the top of the segment 9, which shoulders 19 engage under shoulders 20 formed in the side walls of the corresponding recesses 14 and 15 in the housing body 1, thereby to latch the cover member 8 to the housing body 1, as shown in FIG. 13.

For use of the connector described above, the contact members are inserted into the cavities 2 in the housing body 1, with the strap portions 6 of the contact members being engaged on the shoulders 7 in the cavities 2.

Insulated conductors 100 are then positioned over the contact members, as shown in FIG. 8, with the end of each conductor 100 adjacent the inner surface of the side wall of the recess 15 in the housing body 1.

The cover member 8 is then positioned over the conductors 100 as shown in FIG. 8, and is then urged towards the housing body 1 such that the stuffer members 11, 12 and 13 on the cover member 8 urge the conductors 100 into the slots 5 in the plate portions 4 of the contact members, the walls of the slots 5 penetrating the insulation of the conductors 100 and establishing electrical connections between the conductors 100 and the contact members.

When the cover member 8 has been urged fully home, as shown in FIGS. 9 and 13, the shoulders 19 on the ramps 18 on the cover member 8 become latched under the shoulders 20 on the housing body 1, the cover member 8 thus becoming secured to the housing body 1 with the stuffer members 11, 12 and 13 holding the conductors 100 down in the slots 5 in the associated contact members, as clearly shown in FIGS. 9 and 13.

The now closed channel 17 in the projection 13 of each segment 9 of the cover member 8 serves to receive an end portion of the associated conductor 100 if the conductor has not been accurately positioned over the associated contact member, while the still open channel 16 in the projection 12 serves to receive the conductor 100, as shown in FIGS. 9 and 13, which can be bent to extend at right-angles to its original direction, the channel 16 being formed with inwardly directed projections 21 which serve to secure the conductor 100 in the channel 16.

As clearly shown in FIGS. 9 and 13 each conductor 100 is gripped between the free ends of the projections 12 and 13 on the associated segment 9 of the cover member 8, and internal surfaces 22 and 23 of the housing body 1 and thus the conductor 100 is mechanically secured to the connecter while being electrically connected to the associated contact member thereof.

What is claimed is:

1. An electrical contact member comprising a conductive plate having therein a slot open to an edge of the plate, the slot having a mouth at the edge of the plate and leading to a first inwardly tapering section which leads to a second parallel straight sided section, the second section leading into a third inwardly tapering section having convex converging sides leading to a throat which opens into a fourth outwardly tapering section leading into a fifth inwardly tapering section having convex converging sides, the maximum width of the fifth section being less than that of the third section, the fifth section defining a closed end for the slot.

2. A contact member as claimed in claim 1, in which the first section has converging straight sides.

3. A contact member as claimed in claim 1, in which the fifth section terminates in an enlarged aperture.

4. A contact member as claimed in any preceding claim, in which the sides of the second section are bevelled to provide relatively sharp cutting edges.

5. An electrical contact comprising two contact members as claimed in claim 1, in which the slots in the two contact members are of mutually different widths over their second, third and fourth sections.

6. An electrical contact as claimed in claim 5, in which the two contact members are joined by two bridging strips extending between the plates on opposite sides of the slots therein.

7. An electrical connector comprising a housing of electrically insulating material carrying a plurality of electrical contact members each as claimed in claim 6, in which the housing includes a cover member which serves to urge conductors into the slots in the contacts and then remain secured to the housing body covering the connections between the contacts and the conductors, the cover member being formed with a plurality of stuffer members which serve to engage the conductors to urge them into the slots in respective contacts, and which remain in contact with the conductors thereby serving to retain the conductors in the slots in the respective contacts and mechanically secure the conductors to the connector.

8. A connector as claimed in claim 7, in which the cover member is formed with latching means which co-operates with latching means on the housing body to latch the cover member to the housing body.

9. A connector as claimed in claim 7, in which each conductor connected thereto is gripped between stuffer members on the cover member and surfaces formed on the housing body, on each side of the associated contact.

10. A connector as claimed in claim 7, in which the cover member is formed with three stuffer members for each contact, the stuffer members for each contact being arranged to embrace the plates of the contact between pairs thereof.

11. A connector as claimed in claim 7 or claim 10, in which the bridging strips of each contact engage over shoulders formed on the housing body to support the contact in the associated cavity in the housing body.

12. A connector as claimed in claims 7, in which the housing body has a plurality of cavities each containing an individual contact, the cover member being formed by a plurality of segments each for receipt in an individual cavity in the housing body, the segments being joined by web portions.

13. A connector as claimed in claim 12, in which one end of each segment of the cover member is formed with a channel to receive a conductor connected to the contact associated with that segment, the conductor being bent through a right-angle to extend in the channel.

14. A connector as claimed in claim 13, in which the channel is formed with inwardly directed projections which serve to secure the conductor in the channel.

* * * * *